US011344168B2

(12) United States Patent
Hyun et al.

(10) Patent No.: US 11,344,168 B2
(45) Date of Patent: May 31, 2022

(54) CLEANING APPLIANCE

(71) Applicant: LG ELECTRONICS INC., Seoul (KR)

(72) Inventors: Kietak Hyun, Seoul (KR); Sangchul Lee, Seoul (KR); Jonguk Her, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/059,012

(22) PCT Filed: May 21, 2019

(86) PCT No.: PCT/KR2019/006055
§ 371 (c)(1),
(2) Date: Nov. 25, 2020

(87) PCT Pub. No.: WO2019/231154
PCT Pub. Date: Dec. 5, 2019

(65) Prior Publication Data

US 2021/0204778 A1 Jul. 8, 2021

(30) Foreign Application Priority Data

May 31, 2018 (KR) ..... 10-2018-0062624

(51) Int. Cl.
*A47L 9/16* (2006.01)
*A47L 5/24* (2006.01)
*A47L 9/32* (2006.01)

(52) U.S. Cl.
CPC ..... *A47L 9/1666* (2013.01); *A47L 5/24* (2013.01); *A47L 9/1608* (2013.01); *A47L 9/322* (2013.01)

(58) Field of Classification Search
CPC ..... A47L 9/1666; A47L 9/1608; A47L 9/322; A47L 9/16; A47L 9/165; A47L 9/1616;
(Continued)

(56) References Cited

U.S. PATENT DOCUMENTS 7,563,297 B2 * 7/2009 Kim ..... A47L 9/1625 55/343
2005/0050863 A1 * 3/2005 Oh ..... A47L 9/1625 55/345

(Continued)

FOREIGN PATENT DOCUMENTS

CN 105962846 9/2016
CN 206576819 10/2017

(Continued)

OTHER PUBLICATIONS

PCT International Search Report and Written Opinion for PCT/KR2019/011943 dated Dec. 20, 2019 (3 pages).

(Continued)

*Primary Examiner* — Joseph J Hail
*Assistant Examiner* — Timothy Brady
(74) *Attorney, Agent, or Firm* — Birch, Stewart, Kolasch & Birch, LLP

(57) ABSTRACT

A cleaning appliance comprises a first housing having a hollow cylinder shape; a second housing fixed to a circumferential surface of the first housing; a third housing provided on a circumferential surface of the first housing and having an exhaust hole; a first communication hole between the first and second housings; a fan for moving air from the second communication hole to the exhaust hole; a particle separator for separating particles from the air by centrifugal force; a battery housing protruded from a rear surface of the first housing, wherein the center of gravity of the fan is located between the center of gravity of the particle sepa- (Continued)

rator and the center of gravity of the battery, and a rotary shaft for the fan is parallel with a straight line passing through the center of gravity of the particle separator along a longitudinal direction of the first housing.

11 Claims, 4 Drawing Sheets

(58) Field of Classification Search
CPC .... A47L 9/1625; A47L 9/1633; A47L 9/1658; A47L 9/2884; A47L 9/32; A47L 5/24
USPC ..... 15/347
See application file for complete search history.

(56) References Cited

U.S. PATENT DOCUMENTS

| | | | | |
|---|---|---|---|---|
| 2013/0091661 | A1 | 4/2013 | Smith | |
| 2016/0206169 | A1* | 7/2016 | Hyun | A47L 9/165 |
| 2017/0196423 | A1* | 7/2017 | Brown | H02J 7/0045 |
| 2017/0209010 | A1* | 7/2017 | Peters | A47L 5/24 |
| 2017/0296007 | A1* | 10/2017 | Warren | B01D 46/02 |
| 2018/0303301 | A1* | 10/2018 | Conrad | A47L 9/1683 |
| 2019/0298133 | A1* | 10/2019 | Conrad | A47L 9/2836 |
| 2020/0037834 | A1* | 2/2020 | Li | A47L 9/322 |

FOREIGN PATENT DOCUMENTS

| | | | |
|---|---|---|---|
| CN | 107802206 | A | 3/2018 |
| CN | 108030440 | A | 5/2018 |
| JP | 52-14775 | U | 7/1975 |
| JP | H11-056692 | | 3/1999 |
| JP | 2002-017635 | | 1/2002 |
| JP | 2013-000137 | | 1/2013 |
| JP | 2014-100571 | | 6/2014 |
| JP | 2014-217758 | | 11/2014 |
| JP | 2015-173673 | | 10/2015 |
| JP | 2016-137095 | | 8/2016 |
| KR | 10-0671891 | | 1/2007 |
| KR | 10-2009-0063346 | | 6/2009 |
| KR | 10-2018-0023790 | | 3/2018 |

OTHER PUBLICATIONS

Korean Notice of Allowance in Application No. 10-2018-0062624 dated Nov. 28, 2019 (1 page).

* cited by examiner

CLEANING APPLIANCE

CROSS REFERENCES TO RELATED APPLICATIONS

This application is the National Phase of PCT International Application No. PCT/KR2019/006055, filed on 21 May 2019, which claims priority under 35 U.S.C. 119(a) to Korean Patent Application No. 10-2018-0062624, filed on 31 May 2018. The contents of the above-referenced applications are incorporated by reference herein in their entireties.

BACKGROUND

Technical Field

The present invention relates to a cleaning appliance.

Background Information

A cleaning appliance is an appliance for cleaning the indoor by sucking particles such as dust. It is general that a conventional cleaning appliance comprises a housing provided with an intake unit and an exhaust unit, a fan for moving the air entering the intake unit to the exhaust unit, a separator for separating particles from the air moving by the fan, a battery for supplying a power to the fan, and a handle provided in the housing.

Meanwhile, the conventional cleaning apparatus has a problem in that the center of gravity of the appliance is formed at a position far away from the handle because the intake unit is provided on a front surface of the housing, the handle is provided on a rear surface of the housing and the separator and the fan, which are heavy parts, are provided inside the housing.

The case that the center of gravity of the cleaning appliance is far away from the handle means that the center of gravity of the cleaning appliance is far away from a user's wrist, and if the center of gravity of the cleaning appliance is far away from a user's wrist, a problem occurs in that a big force is required for direction switching or position change of the cleaning appliance.

Also, the fan provided in the conventional cleaning appliance is generally provided to discharge the air toward the handle. However, in this case, since the air is discharged to the user's hands which are gripping the handle, a problem occurs in that displeasure is caused to the user.

SUMMARY

Technical Problem

An object of the present invention is to provide a cleaning appliance of which handling is easy.

Another object of the present invention is to provide a cleaning appliance which is capable of preventing the air from being discharged toward a user's hands.

Technical Solution

The present invention provides a cleaning appliance comprising a first housing provided in a hollow cylinder shape; a second housing fixed to a circumferential surface of the first housing along a longitudinal direction of the first housing and provided with an intake unit through which the air enters; a third housing provided on a circumferential surface of the first housing along the longitudinal direction of the first housing and provided with an exhaust hole; a first communication hole for communicating the first housing with the second housing; a first communication hole for communicating the first housing with the second housing; a fan provided to include an impeller located in the third housing, a rotary shaft to which the impeller is fixed, and a motor rotating the rotary shaft, moving the air supplied from the second communication hole to the exhaust hole; a particle separator provided inside the first housing to provide a path for guiding the air entering the first communication hole to the second communication hole, separating particles from the air by using a centrifugal force; a battery housing protruded from a rear surface of the first housing located in a direction opposite to a position of the intake unit toward a direction far away from the first housing; a battery provided in the battery housing, supplying a power to the motor; and a handle having one end fixed to a rear surface of the third housing located in a direction opposite to the position of the intake unit and the other end fixed to the battery housing, wherein the center of gravity of the fan is located between the center of gravity of the particle separator and the center of gravity of the battery, and rotary shaft is parallel with a first reference line passing through the center of gravity of the particle separator along the longitudinal direction of the first housing.

The center of gravity of the fan may be located above the first reference line, and the center of gravity of the battery may be located below the first reference line.

The center of gravity of the handle may be located between the first reference line and a second reference line passing through the center of gravity of the fan along the longitudinal direction of the first housing.

The center of gravity of the fan, the center of gravity of the particle separator, the center of gravity of the battery, and the center of gravity of the handle may all be located on a single plane that includes the first reference line and the second reference line.

The handle may include a first handle body extended from the rear surface of the third housing along a longitudinal direction of the rotary shaft, providing a space for grip of a user, and a second handle body provided to connect a free end of the first handle body with an upper surface of the battery housing, providing a space for grip of a user.

A connection point of the first handle body and the second handle body may be located between the first reference line and the second reference line.

The first handle body may be inclined from the rear surface of the third housing toward the battery housing, and the second handle body may be inclined toward the rear surface of the third housing.

The particle separator may include a partition for partitioning an inner space of the first housing into a front space communicated with the first communication hole and a rear space communicated with the second communication hole, a partition through hole provided to pass through the partition, chamber bodies provided in a hollow cylinder shape, having one end fixed to the partition and the other end which is in contact with the front surface of the first housing, and partitioning the front space into a first chamber communicated with the first communication hole and a second chamber communicated with the partition through hole, a body partition partitioning an inner space of the second chamber into a first space communicated with the partition through hole and a second space which is not communicated with the partition through hole, a through hole provided to pass through the chamber bodies to communicate the first space with the first chamber, a path body provided in a pipe surrounding the partition through hole, having one end fixed to the partition and the other end communicated with the second space by passing through the body partition, a discharge pipe provided as a pipe extended from the partition through hole toward the body partition and provided inside the path body, an inlet provided to pass through the path body, guiding the air supplied to the through hole to the inside the path body, and an air flow forming portion provided in a screw shape between the discharge pipe and the path body, rotating the air entering the inlet inside the path body.

The fan may include a case provided in the third housing, storing the impeller therein, a case intake unit provided on one surface of the case headed for a rear surface of the third housing to allow the air to enter the inside of the case, and a case exhaust hole provided on one surface of the case headed for a front surface of the third housing to discharge the air inside the case to the outside, and the rotary shaft may be located on a straight line passing through the center of the case intake unit and the center of the case exhaust hole.

The cleaning appliance of the present invention may further comprise a first filter located between the second communication hole and the case intake unit, filtering the air, and a second filter located between the case exhaust hole and the exhaust hole to filter the air, wherein the second filter is provided to filter particles smaller than those filtered by the first filter.

The cleaning appliance of the present invention may further comprise a first filter located between the partition through hole and the second communication hole, filtering particles, and a second filter located between the case exhaust hole and the exhaust hole to filter particles, wherein the second filter is provided to filter particles smaller than those filtered by the first filter.

Advantageous Effects

The present invention may provide a cleaning appliance that improves a user's convenience (handling) by decentering the center of gravity of components constituting the cleaning appliance based on a user's wrist.

Also, the present invention may provide a cleaning appliance which is capable of preventing the air from being discharged toward a user's hands.

DETAILED DESCRIPTION

Hereinafter, the present disclosure will be described with reference to drawings and embodiments, which specifically specify components of the present invention but are used to assist understanding of the present invention.

Also, specific components in the following embodiment may be exaggerated or downsized for convenience of description and understanding. Therefore, the present invention is not limited to the embodiment described below, and various corrections and modifications may be made from the embodiment by the person with ordinary skill in the art to which the present invention pertains.

Figure 1:
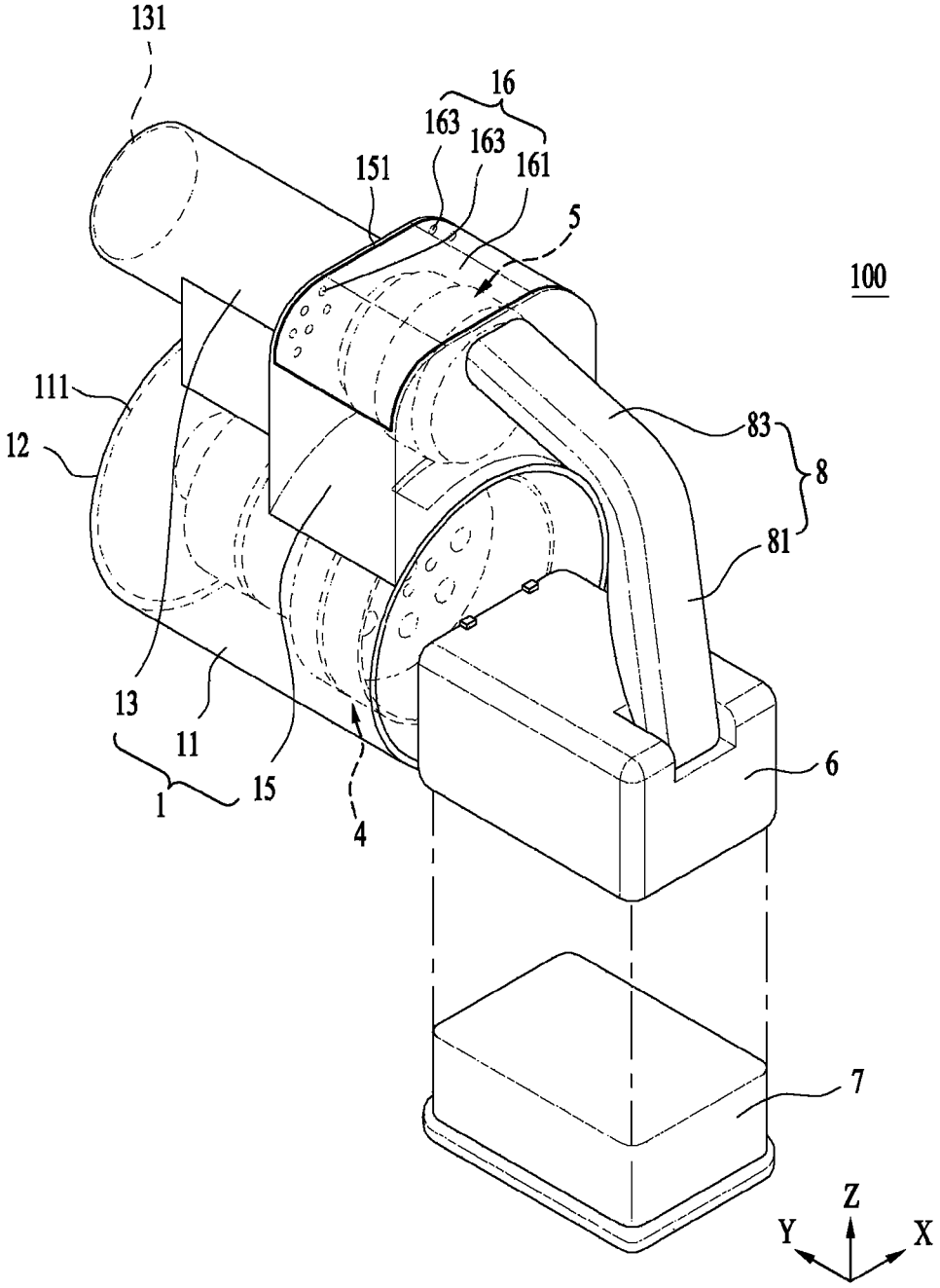
FIGS. 1 and 2 illustrate an example of a cleaning appliance of the present invention.

FIG. 1 illustrates an example of a cleaning appliance 100 of the present invention. The cleaning appliance of the present invention comprises a housing 1 provided with a plurality of spaces 11, 12 and 15 partitioned from one another, an intake hole 131 for allowing the air to enter the housing 1, an exhaust hole 163 for allowing the air inside the housing 1 toward the outside of the housing 1, a fan 5 provided inside the housing 1, discharging the air inside the housing 1 toward the exhaust hole 163, a particle separator 4 for guiding the air entering the intake hole 131 to the fan 5 and separating particles from the air by using a centrifugal force, and a handle 8 provided in the housing 1 to allow a user to grip it.

The handle 7 may be provided to be located at a point (spaced point of 180°) symmetrical to a point, in which the intake unit 11 is located, in a space provided by a circumferential surface of the housing 1.

The housing 1 may be provided in a hollow cylinder shape. The housing 1 includes a first housing 11 providing a space in which the particle separator 4 is stored, a second housing 13 fixed to a circumferential surface of the first housing 11 and provided with the intake hole 131, and a third housing 15 fixed to a circumferential surface of the first housing 11 and provided with the fan and the exhaust hole 163.

The second housing 13 and the third housing 15 may be provided along a longitudinal direction of the first housing 11. That is, a horizontal line passing through the center of the second housing 13 may be fixed to the circumferential surface of the first housing 11 to be parallel with a horizontal line passing through the center of the first housing 11, and a horizontal line passing through the center of the third housing 15 may also be fixed to the circumferential surface of the first housing 11 to be parallel with the horizontal line passing through the center of the first housing 11.

The case that the horizontal line passing through the center of the first housing is parallel with the horizontal line passing through the center of the second housing 11 or the third housing means that a straight line passing through the center of the first housing is provided so as not to meet a straight line passing through the center of the second housing or the third housing. However, the second housing 13 and the third housing 15 may be fixed to the first housing 11 such that the horizontal line passing through the center of the second housing 13 is matched with the horizontal line passing through the center of the third housing 15.

Figure 2:
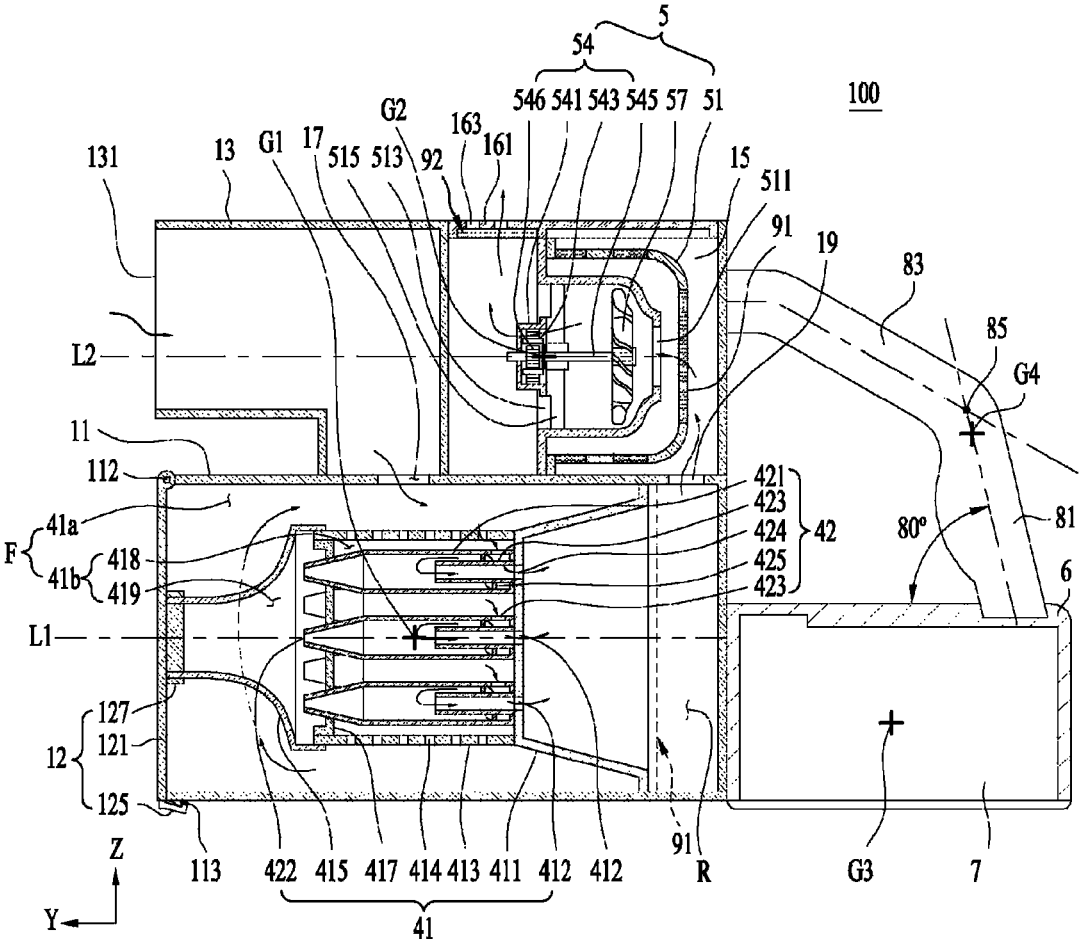

As shown in FIG. 2, the first housing 11 is communicated with the second housing 13 through a first communication hole 17, and is communicated with the third housing 15 through a second communication hole 19. The air entering the intake hole 131 moves to the first housing 11 through the first communication hole 17, and the air inside the first housing 11 moves to the third housing 15 through the second communication hole 19.

A first housing discharge hole 111 opened or closed by a first cover 12 is provided on a front surface (point spaced apart from the point, in which the handle is located, as much as 180°, one surface of the first housing toward a direction where the intake hole is located) of the first housing 11.

The first cover 12 may rotatably be provided in the first housing 11. In this case, a shaft 112 forming a rotation center of the first cover and a fastening unit 113 provided to face the shaft 112 may be provided on the circumferential surface of the first housing 11, and a first cover body 121 coupled to the shaft 112 and a cover fastening unit 125 provided on a free end of the first cover body 121 and detachably coupled to the fastening unit 113 may be provided in the first cover 12.

Moreover, a sealing portion 127 compressed between the first housing 11 and the first cover body 121 when the first housing discharge hole 111 is closed may further be provided in the first cover 12. Preferably, the sealing portion 127 is made of an elastic body such as rubber.

As shown in FIG. 1, a third housing discharge hole 151 opened or closed by a second cover 16 may be provided on a circumferential surface of the third housing 15. The third housing discharge hole 151 may be provided to pass through a surface, which is parallel with the circumferential surface of the first housing 11, in a space provided by the third housing 15. In this case, the third housing discharge hole 151 may be provided in a space, which is located in a direction (Z-axis direction) orthogonal to a longitudinal direction (Y-axis direction) of the handle 8, in the space provided by the third housing 15.

The second cover 16 is provided with a second cover body 161 for opening or closing the third housing discharge hole 151, wherein the second cover body 161 may be provided to form the circumferential surface of the third housing 15 when the third housing discharge hole 151 is closed. In this case, the exhaust hole 163 may be provided with a plurality of holes passing through the second cover body 161.

The fan 5 is a means provided in the third housing 15, moving the air inside the housing 1 to the exhaust hole 163, and the particle separator 4 is a means provided in the first housing 11, providing a path for guiding the air entering the first housing 11 through the first communication hole 17 to the second communication hole 19. Particles such as dust contained in the air are separated from the air by a centrifugal force while the particle separator 4 is moving to the fan 5 along the path. A detailed structure of the particle separator is as follows.

As shown in FIG. 2, the particle separator 4 includes a chamber forming portion 41 for forming a first chamber 41*a* and a second chamber 41*b* inside the first housing 1, and a cyclone forming portion 42 for forming an air current arousing a centrifugal force while supplying the air inside the second chamber 41*b* to the fan 5.

The chamber forming portion 41 may include a partition 411 for partitioning an inner space of the first housing 1 into a front space F communicated with the first communication hole 17 and a rear space R communicated with the second communication hole 19, a partition through hole 412 provided to pass through the partition 411, chamber bodies 413 and 415 provided as a cylinder having one end fixed to the partition 411 and the other end which is in contact with the first cover 12, partitioning the front space R into two chambers 41*a* and 41*b*, and a body partition 417 for partitioning the second chamber 41*b* formed inside the chamber body 415 into a first space 418 and a second space 419.

The chamber bodies may be provided as a first body 413 fixed to the partition 411 and a second body 415 fixed to the first body. In this case, the partition through hole 412 communicates the second chamber 41*b* with the rear space R of the first housing. That is, the first body 413 should be provided in a shape surrounding the partition through hole 412.

The first body 413 and the second body 415 may be provided in a hollow cylinder shape, and the second body 415 may be provided such that its one end is fixed to a free end of the first body 413 and its other end is in contact with the sealing portion 127 of the first cover.

A plurality of body through holes 414 for communicating the first chamber 41*a* with the first space 418 are provided on a circumferential surface of the first body 413. Therefore, the air entering the first chamber 41*a* through the intake hole 131 and the first communication hole 17 may be supplied to the first space 418 of the second chamber 41*b* through the body through holes 414.

The body partition 417 is fixed to any one of the first body 413 and the second body 415 to partition the inside of the second chamber 41*b* into two spaces 418 and 419. The first space 418 is a space communicated with the partition through hole 412, and the second space 419 is a space which is not communicated with the partition through hole 412.

A body discharge hole 416 (see FIG. 3) opened or closed by the first cover body 121 is provided on the bottom of the second body 415. Therefore, if the first cover body 121 opens the first housing discharge hole 111, the body discharge hole 416 will be opened.

Figure 3:
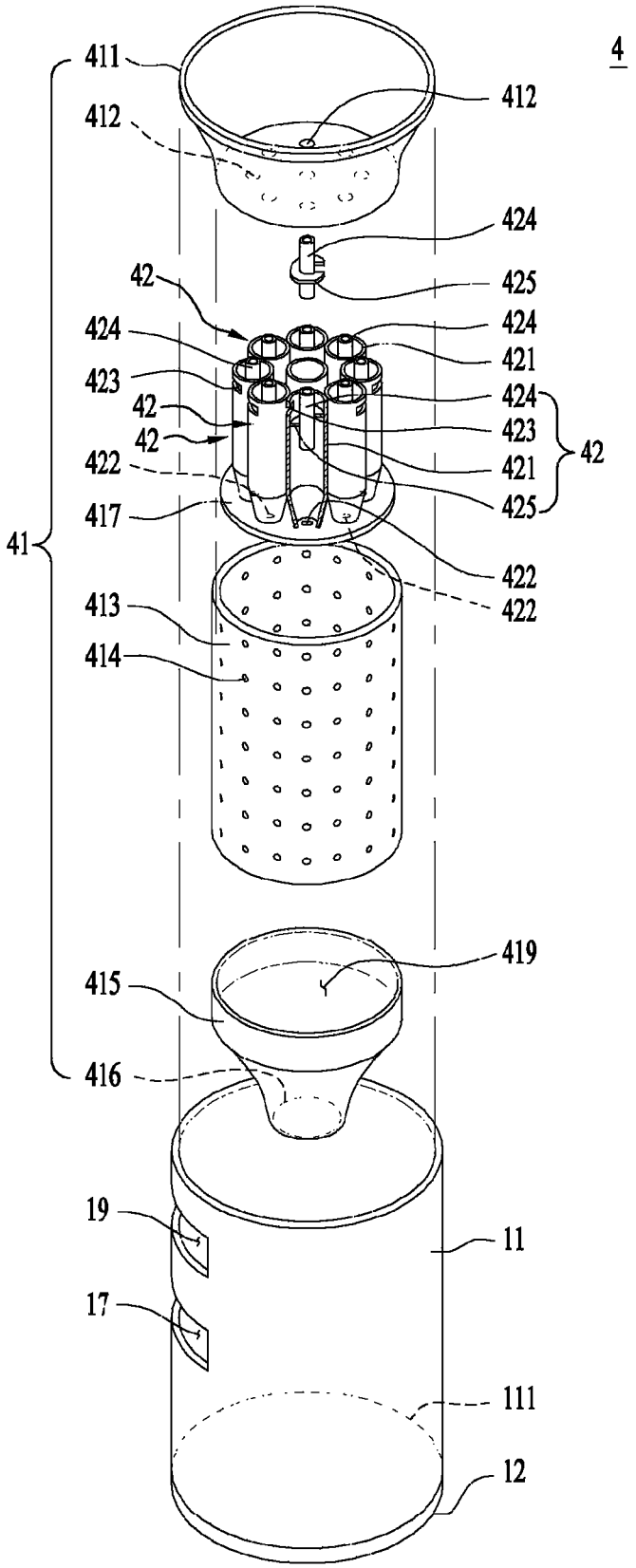
FIGS. 3 and 4 illustrate an example of a particle separator provided in the present invention.

As shown in FIG. 3, the cyclone forming portion 42 may include a path body 421 of which one end is fixed to the partition 411 and the other end is communicated with the second space 419 by passing through the body partition 417, a discharge pipe 424 located inside the path body 421 and communicated with the partition through hole 412, an inlet 423 provided to pass through a circumferential surface of the path body 421, and an air flow forming portion 425 provided between an outer circumferential surface of the discharge pipe 424 and an inner circumferential surface of the path body.

The path body 421 is provided as a pipe surrounding the partition through hole 412, and the discharge pipe 424 is located inside the path body 421. The path body 421 is communicated with the second space 419 through a particle discharge hole 422 provided at one end (one end of the path body which is not fixed to the partition). The path body 421 may be provided to have a diameter which becomes smaller toward a free end. This is to strongly maintain intensity of the air flow.

The air flow forming portion 425 is provided in a screw shape, and the inlet 423 is located to be higher than the air flow forming portion 425. Therefore, the air entering the path body 421 through the inlet 423 when the fan 5 is operated will move (cyclone movement) to be rotated inside the path body 421 in the middle of moving to the discharge pipe 424 through the air flow forming portion 425.

If cyclone movement occurs inside the path body 421, the particles contained in the air move to a rim (the circumferential surface of the path body) of the path by means of a centrifugal force and then remain in the path body 421 by means of gravity, and the air will be discharged to the rear space R through the discharge pipe 424.

Unlike the shown drawing, the inlet 423 may be provided as a hole provided to pass through an upper surface of the path body 421. In this case, an upper end of the path body 421 should be provided to be spaced apart from the partition 411 without being fixed to the partition 411. Since the path body 421 is fixed to the partition 411 through the air flow forming portion 425 and the discharge pipe 424, the path body 421 may maintain a state fixed to the partition 411 even though the upper end of the path body 421 is spaced apart from the partition 411.

The cyclone forming portion 42 having the aforementioned structure may be provided with a plurality of cyclone forming portions. FIG. 3 illustrates an example of a particle separator 4 provided with nine cyclone forming portions 42.

As shown in FIG. 2, the fan 5 may include a case 51 provided in the third housing 15, an impeller 57 rotatably provided inside the case, and a motor 54 fixed to the case, rotating the impeller 57.

The case 51 is provided with a case intake hole 511 and a case exhaust hole 513, wherein the case intake hole 511 is a means for allowing the air discharged from the second communication hole 19 to enter the case 51, and the case exhaust hole 513 is a means for allowing the air inside the case 51 to be discharged to the discharge hole 163.

The case intake hole 511 and the case exhaust hole 513, which are capable of performing the aforementioned function, may be located anywhere in a space provided by the case 51. FIG. 2 illustrates an example of a case that the case intake hole 511 is provided to pass through one surface of the case 51 headed for a rear surface (surface to which a handle is fixed) of the third housing 15 and the case exhaust hole 513 is provided to pass through one surface of the case 51 headed for a front surface of the third housing 15.

The motor 54 is fixed to a support 515 provided in the case 51. FIG. 2 illustrates an example of a case that the support 515 is located between the case intake hole 511 and the case exhaust hole 513 and a rotary shaft 545 is connected to the impeller 57 by passing through the support 515. That is, the motor 54 may include a fixed unit 541 fixed to the support 515, a stator 543 provided inside the fixed unit, and a permanent magnet 546 fixed to a free end (one of a rotary shaft located inside the fixed unit) of the rotary shaft 545. The rotary shaft 545 may be located on a straight line passing through the center of the case intake hole 511 and the center of the case exhaust hole 513.

Meanwhile, for filtering particles which are not removed through the particle separator 4, the present invention may further include at least one of a first filter 91 and a second filter 92. FIG. 2 illustrates an example of a case that the first filter 91 and the second filter 92 are provided in the cleaning appliance 100 of the present invention.

The first filter 91 may be located between the second communication hole 19 and the case intake hole 511 and provided to filter the air, and the second filter 92 may be located between the case exhaust hole 513 and the exhaust hole 163 and provided to filter the air.

The first filter 91 and the second filter 92 may be provided to filter particles having the same size, or may be provided to filter particles having different sizes. In the latter case, it is preferable that the second filter 92 filters particles smaller than those filtered by the first filter 91. This is to minimize the amount of fine dust discharged to an indoor space.

In this case, a user may clean the first filter 91 and the second 92 by detaching them from the third housing 15 when detaching the second cover 16 from the third housing 15.

Unlike the aforementioned description, the first filter 91 may be located between the partition through hole 412 and the second communication hole 19 to filter the air. In this case, it is preferable that the first filter 91 is provided to be drawn out of the first housing 11 through the circumferential surface of the first housing 11 and the second filter 92 is provided to detached from the third housing through the third housing discharge hole 151.

The motor 54 provided in the fan 5 may be provided to be supplied with a power through a power source provided indoor, or may be provided to be supplied with a power through a battery 7 detachably provided in the housing 1. In the latter case, the first housing 11 should be provided with a battery housing 6 for storing the battery 7.

The battery housing 6 may be provided to be protruded from a rear surface (surface opposite to a position of the intake hole) of the first housing 11 toward a direction far away from the intake hole. In this case, one end of the handle 8 may be fixed to a rear surface (surface opposite to a position of the intake hole) of the third housing 15 and the other end of the handle 8 may be fixed to the battery housing 6.

That is, the handle 8 may be provided with a first handle body 83 fixed to the rear surface of the third housing 15, and a second handle body 81 connecting a free end of the first handle body 83 with an upper surface of the battery housing 6.

The first handle body 83 is provided in a bar shape extended to a direction far away from the rear surface of the third housing 15. One end of the second handle body 81 may be connected to a free end of the first handle body 83, and the other end of the second handle body 81 may be fixed to an upper surface of the battery housing 6. This is to allow a user to handle the cleaning appliance 100 even by using the first handle body 83 or to handle the cleaning appliance 100 even by using the second handle body 81.

Preferably, the first handle body 83 is provided to be inclined from the rear surface of the third housing 15 toward the battery housing 6, and the second handle body 81 is provided to be inclined toward the rear surface of the third housing 15.

The battery 7 may detachably be coupled to the battery housing 6 through an insertion hole provided to pass through the bottom of the battery housing 6 or a side of the battery housing 6.

If a height of the battery housing 6 is increased, since a length of the handle 8 may be reduced to cause inconvenience of a user, it is preferable that a length (length of Y-axis directional battery) of the battery 7 from the rear surface of the first housing 11 to a direction where the first handle body 83 is located is set to be longer than a length (length of Z-axis directional battery) of the battery 7 with respect to a height direction of the housing 1 and a length (length of X-axis directional battery) of the battery with respect to a diameter direction of the first housing 11.

Figure 4:
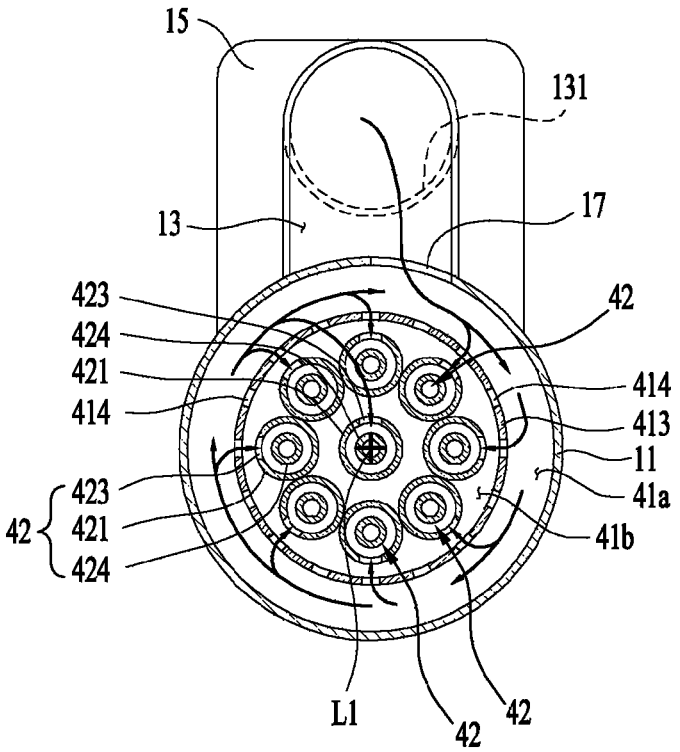

Hereinafter, an operation process of the cleaning appliance having the aforementioned structure will be described with reference to FIG. 4.

If a power is supplied to the motor 54 to rotate the impeller 57, the air enters the first chamber 41*a* through the intake hole 131 and the first communication hole 17. Since the first communication hole 17 allows the air to enter the first chamber 41*a* along a tangent direction of a circumferential surface of the first chamber 41*a*, the air entering the first chamber 41*a* will cyclone move along the circumferential surface of the first chamber 41*a*.

If the air cyclone moves inside the first chamber 41*a*, particles will move to the circumferential surface of the first chamber 41*a* by a centrifugal force and then remain in the first housing by gravity, and the air will enter the second chamber 41*b* through the body through holes 414.

The air entering the second chamber 41*b* moves to the path body 421 through the inlet 423, and the air entering the path body 421 will cyclone move during the process of passing through the air flow forming portion 425.

If cyclone movement occurs in the path body 421, the particles contained in the air move to the circumferential surface of the path body 421 by a centrifugal force and then remain in the path body by gravity, and the air will be discharged to the outside of the housing 1 through the discharge pipe 424, the partition through hole 412, the second communication hole 19, the case intake hole 511, the case exhaust hole 513, and the exhaust hole 163.

Since the air discharged from the cleaning appliance through the exhaust hole 163 is discharged in a direction orthogonal to the position of the handle 8, in the present invention, it is possible to prevent the air discharged from the cleaning appliance from being headed for a user's hands.

Meanwhile, the user may remove the particles collected in the second space 419 and the first chamber 41*a* by opening the first housing discharge hole 11 through the first cover 12.

As shown in FIG. 2, the center of gravity G2 of the fan is provided between the center of gravity G1 of the particle separator and the center of gravity G3 of the battery, and the rotary shaft 545 of the fan is provided in parallel with a straight line L1 (first reference line) passing through the center of gravity G1 of the particle separator along a longitudinal direction (Y-axis direction) of the first housing 11.

The case that the rotary shaft 545 of the fan is provided in parallel with a straight line L1 passing through the center of gravity of the particle separator means that a straight line L2 (second reference line, horizontal line passing through the center of gravity of the fan) passing through the center of the rotary shaft along a longitudinal direction of the rotary shaft 545 does not meet the straight line L1 passing through the center of gravity of the particle separator by being spaced apart from the straight line L1 along a height direction (Z-axis direction) of the housing 1.

If the particle separator 4 and the fan 5 are located up and down and thus two centers of gravities G1 and G2 are located on a vertical line, a problem occurs in that the center of gravity of the cleaning apparatus is far away from the handle 8. The case that the center of gravity of the cleaning apparatus is far away from the handle 8 means that the center of gravity of the cleaning apparatus is located to be far away from the user's wrist, and if the center of gravity of the cleaning appliance is far away from the user's wrist, a problem occurs in that a big force is required for direction switching or position change of the cleaning appliance.

The case that the center of gravity G2 of the fan is located between the center of gravity G1 of the particle separator and the center of gravity G3 of the battery becomes a means for solving the problem that a big force is required for manipulation of the cleaning appliance by moving the center of gravity of the cleaning apparatus to a direction close to the handle 8.

Meanwhile, if the rotary shaft is located in the straight line L1 passing through the center of gravity of the particle separator even though the center of gravity G2 of the fan is located between the center of gravity G1 of the particle separator and the center of gravity G3 of the battery, the center of gravity of the cleaning apparatus will be far away from the handle 8. Therefore, the case that the rotary shaft 545 is not located on the straight line L1 passing through the center of gravity of the particle separator becomes a means for solving the problem that a big force is required for manipulation of the cleaning appliance.

Moreover, it is preferable that the center of gravity G2 of the fan is located to be higher than the center of gravity G1 of the particle separator, and the center of gravity G1 of the particle separator is located to be higher than the center of gravity G3 of the battery. That is, the center of gravity G2 of the fan may be provided to be located above the straight line L1 passing through the center of gravity of the particle separator and the center of gravity G3 of the battery may be provided to be located below the straight line L1 passing through the center of gravity of the particle separator.

Meanwhile, the center of gravity G4 of the handle may be provided to be located between the straight line L2 passing through the center of gravity G2 of the fan and the straight line passing through the center of gravity G1 of the particle separator. In this case, it is preferable that a connection point 85 between the first handle body 81 and the second handle body 83 is located between the straight line L2 passing through the rotary shaft 545 and the straight line L1 passing through the center of gravity of the particle separator. This is to allow a user to handle the cleaning apparatus 100 by using a small force through any one of the handle bodies 81 and 83.

Figure 5:
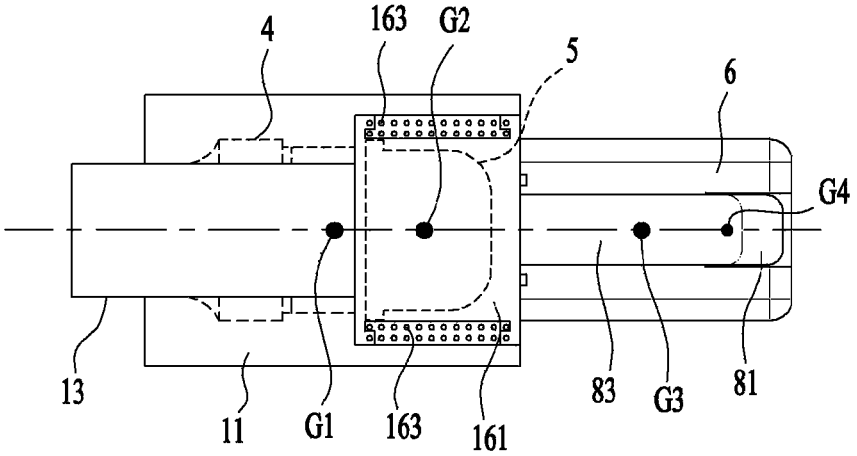
FIG. 5 illustrates the center of gravity of main components constituting a cleaning appliance of the present invention.

As shown in FIG. 5, it is preferable that the center of gravity G2 of the fan, the center of gravity G1 of the particle separator, the center of gravity G3 of the battery, and the center of gravity G4 of the handle are provided on a single plane (height directional section of the cleaning apparatus). This is because that the case that the centers of gravities G1, G2, G3 and G4 are all located on a height directional section (Z-axis direction) of the cleaning apparatus is more favorable for handling of the cleaning apparatus.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

The invention claimed is:

1. A cleaning appliance comprising:

a first housing provided in a hollow cylinder shape;

a second housing fixed to a top circumferential surface of the hollow cylinder shape of the first housing along a longitudinal direction of the first housing and provided with an intake unit through which the air enters;

a third housing provided on the top circumferential surface of the hollow cylinder shape of the first housing along the longitudinal direction of the first housing and provided with an exhaust hole;

a first communication hole for communicating the first housing with the second housing;

a second communication hole for communicating the first housing with the third housing;

a fan provided to include an impeller located in the third housing, a rotary shaft to which the impeller is fixed, and a motor rotating the rotary shaft, moving the air supplied from the second communication hole to the exhaust hole;

a particle separator provided inside the first housing to provide a path for guiding the air entering the first communication hole to the second communication hole, separating particles from the air by using a centrifugal force;

a battery housing protruded from a circular surface at a rear end of the hollow cylinder shape of the first housing located in a direction opposite to a position of the intake unit toward a direction far away from the first housing;

a battery provided in the battery housing, supplying a power to the motor; and a handle having one end fixed to a rear surface of the third housing located in a direction opposite to the position of the intake unit and the other end fixed to the battery housing, wherein a center of gravity of the fan is located between a center of gravity of the particle separator and a center of gravity of the battery, and rotary shaft is parallel with a first reference line passing through the center of gravity of the particle separator along the longitudinal direction of the first housing.

2. The cleaning appliance of claim 1, wherein the center of gravity of the fan is located above the first reference line, and the center of gravity of the battery is located below the first reference line.

3. The cleaning appliance of claim 2, wherein a center of gravity of the handle is located between the first reference line and a second reference line passing through the center of gravity of the fan along the longitudinal direction of the first housing.

4. The cleaning appliance of claim 3, wherein the center of gravity of the fan, the center of gravity of the particle separator, the center of gravity of the battery, and the center of gravity of the handle are all located on a single plane that includes the first reference line and the second reference line.

5. The cleaning appliance of claim 4, wherein the handle includes:

a first handle body extended from the rear surface of the third housing along a longitudinal direction of the rotary shaft, providing a space for grip of a user; and a second handle body provided to connect a free end of the first handle body with an upper surface of the battery housing, providing a space for grip of a user.

6. The cleaning appliance of claim 5, wherein a connection point of the first handle body and the second handle body is located between the first reference line and the second reference line.

7. The cleaning appliance of claim 6, wherein the first handle body is inclined from the rear surface of the third housing toward the battery housing, and the second handle body is inclined toward the rear surface of the third housing.

8. The cleaning appliance of claim 6, wherein the particle separator includes:

a partition for partitioning an inner space of the first housing into a front space communicated with the first communication hole and a rear space communicated with the second communication hole;

a partition through hole provided to pass through the partition;

chamber bodies provided in a hollow cylinder shape, having one end fixed to the partition and the other end which is in contact with the front surface of the first housing, and partitioning the front space into a first chamber communicated with the first communication hole and a second chamber communicated with the partition through hole;

a body partition partitioning an inner space of the second chamber into a first space communicated with the partition through hole and a second space which is not communicated with the partition through hole;

a through hole provided to pass through the chamber bodies to communicate the first space with the first chamber;

a path body provided in a pipe surrounding the partition through hole, having one end fixed to the partition and the other end communicated with the second space by passing through the body partition;

a discharge pipe provided as a pipe extended from the partition through hole toward the body partition and provided inside the path body;

an inlet provided to pass through the path body, guiding the air supplied to the through hole to the inside the path body; and an air flow forming portion provided in a screw shape between the discharge pipe and the path body, rotating the air entering the inlet inside the path body.

9. The cleaning appliance of claim 8, wherein the fan includes:

a case provided in the third housing, storing the impeller therein;

a case intake hole provided on one surface of the case headed for a rear surface of the third housing to allow the air to enter the inside of the case; and a case exhaust hole provided on one surface of the case headed for a front surface of the third housing to discharge the air inside the case to the outside, and the rotary shaft is located on a straight line passing through the center of the case intake hole and the center of the case exhaust hole.

10. The cleaning appliance of claim 9, further comprising:

a first filter located between the second communication hole and the case intake hole, filtering the air; and a second filter located between the case exhaust hole and the exhaust hole to filter the air, wherein the second filter is provided to filter particles smaller than those filtered by the first filter.

11. The cleaning appliance of claim 9, further comprising:

a first filter located between the partition through hole and the second communication hole, filtering particles; and a second filter located between the case exhaust hole and the exhaust hole to filter particles, wherein the second filter is provided to filter particles smaller than those filtered by the first filter.

* * * * *